US009076615B2

(12) United States Patent
Baks et al.

(10) Patent No.: US 9,076,615 B2
(45) Date of Patent: Jul. 7, 2015

(54) METHOD OF FORMING AN INTEGRATED ELECTROMECHANICAL RELAY

(71) Applicant: International Business Machines Corporation, Armonk, NY (US)

(72) Inventors: Christian Wilhelmus Baks, Poughkeepsie, NY (US); Richard A. John, Yorktown Heights, NY (US); Young Hoon Kwark, Chappaqua, NY (US)

(73) Assignee: International Business Machines Corporation, Armonk, NY (US)

( * ) Notice: Subject to any disclaimer, the term of this patent is extended or adjusted under 35 U.S.C. 154(b) by 154 days.

(21) Appl. No.: 13/898,576

(22) Filed: May 21, 2013

(65) Prior Publication Data

US 2013/0247362 A1 Sep. 26, 2013

Related U.S. Application Data

(62) Division of application No. 13/425,896, filed on Mar. 21, 2012, now Pat. No. 8,525,623, which is a division of application No. 12/701,957, filed on Feb. 8, 2010, now Pat. No. 8,436,701.

(51) Int. Cl.

| | |
|---|---|
| ***H01H 11/00*** | (2006.01) |
| ***H01H 11/02*** | (2006.01) |
| ***H01H 11/04*** | (2006.01) |
| ***H01H 65/00*** | (2006.01) |
| ***H01H 49/00*** | (2006.01) |
| ***H01H 50/00*** | (2006.01) |
| *H01F 7/06* | (2006.01) |
| *H01H 50/16* | (2006.01) |

(52) U.S. Cl.

CPC ..... *H01H 49/00* (2013.01); *Y10T 29/49075* (2015.01); *H01F 2007/068* (2013.01); *H01H 50/005* (2013.01); *H01H 50/16* (2013.01)

(58) Field of Classification Search

USPC ..... 29/592.1, 594, 609.1, 622, 623, 623.5, 29/846, 854; 200/181; 335/78; 361/605, 361/611, 648, 649

See application file for complete search history.

(56) References Cited

U.S. PATENT DOCUMENTS

| | | | |
|---|---|---|---|
| 3,898,595 | A | 8/1975 | Launt |
| 6,016,092 | A | 1/2000 | Qiu et al. |

(Continued)

FOREIGN PATENT DOCUMENTS

| | | |
|---|---|---|
| WO | WO00/65619 | 11/2000 |

*Primary Examiner* — Paul D Kim

(74) *Attorney, Agent, or Firm* — Anne V. Dougherty; Ryan, Mason & Lewis, LLP

(57) ABSTRACT

A method is provided to form an electromechanical relay. A magnetic layer is etched to form a substrate-metal structure having a pattern of conductive contacts. The substrate-metal structure is electroplated. The electroplated structure is attached to a printed circuit board (PCB). A portion of the electroplated structure is removed to electrically decouple the conductive contacts. The PCB includes a common contact terminal aligned to one end of each conductive contact. The PCB includes magnetic actuators each having a magnetic core with a first core part disposed within a via extending through layers of the PCB, and an electrical coil disposed around the first core part within layers of the PCB. Each conductive contact is aligned to an associated magnetic actuator to enable electrical contact between the common contact terminal and the conductive contact upon activation of the associated magnetic actuator.

6 Claims, 8 Drawing Sheets

(56) References Cited

U.S. PATENT DOCUMENTS

| | | | | |
|---|---|---|---|---|
| 6,084,281 | A | 7/2000 | Fullin et al. | |
| 6,310,526 | B1 | 10/2001 | Yip et al. | |
| 6,410,360 | B1 * | 6/2002 | Steenberge | 438/52 |
| 6,624,720 | B1 | 9/2003 | Allison et al. | |
| 6,750,745 | B1 | 6/2004 | Wei et al. | |
| 6,778,045 | B2 | 8/2004 | Orr | |
| 6,888,420 | B2 | 5/2005 | Schaffner et al. | |
| 7,157,993 | B2 | 1/2007 | DeNatale et al. | |
| 7,482,899 | B2 * | 1/2009 | Shen et al. | 335/78 |
| 8,068,002 | B2 * | 11/2011 | Shen | 335/78 |
| 8,159,320 | B2 * | 4/2012 | Ruan et al. | 335/78 |
| 8,188,817 | B2 * | 5/2012 | Shen | 335/78 |
| 8,519,810 | B2 * | 8/2013 | Ruan et al. | 335/78 |
| 2003/0011458 | A1 | 1/2003 | Nuytkens et al. | |
| 2003/0151480 | A1 | 8/2003 | Orr | |
| 2004/0244191 | A1 | 12/2004 | Orr et al. | |
| 2006/0175203 | A1 | 8/2006 | Davis et al. | |
| 2007/0029659 | A1 | 2/2007 | Heck et al. | |
| 2010/0171577 | A1 | 7/2010 | Christenson | |
| 2010/0182111 | A1 | 7/2010 | Hagihara et al. | |
| 2012/0161909 | A1 | 6/2012 | Wilson et al. | |
| 2012/0200377 | A1 | 8/2012 | Lee et al. | |

* cited by examiner

METHOD OF FORMING AN INTEGRATED ELECTROMECHANICAL RELAY

CROSS-REFERENCE TO RELATED APPLICATIONS

This application is a Divisional of U.S. patent application Ser. No. 13/425,896, filed on Mar. 21, 2012, now U.S. Pat. No. 8,525,623, which is a Divisional of U.S. patent application Ser. No. 12/701,957, filed on Feb. 8, 2010, now U.S. Pat. No. 8,436,701, the disclosures of which are fully incorporated herein by reference.

FIELD OF THE INVENTION

The present invention relates generally to switching devices and more particularly to integrated electromechanical relays formed within substrates such as printed circuit board, semiconductor structures and microelectromechanical systems.

BACKGROUND OF THE INVENTION

An electromechanical relay is an electrically operated mechanical switch. Electromechanical relays may use an electromagnet to move a mechanical component to make or break a conduction path for a signal. Relays may be used to control a radio frequency signal via a control signal. Multiple pole relays may be used to switch a plurality of conduction paths to a common node.

Microwave signals typically are carried on transmission lines. Transmission lines may be coupled to other transmission lines, to electronic devices or to electromechanical relays by connectors. The connectors are designed to minimize signal loss, distortion and impedance mismatches between the coupled transmission lines. However, in general, the longer the length of the transmission line and the more connectors in a signal path, the greater the signal loss, distortion and impedance mismatch.

Multiple pole microwave electromechanical relays may switch a multiplicity of broadband signals to a separate common coaxial transmission line. However, conventional microwave relays are relatively expensive, bulky and require interfaces to separate transmission lines through connectors. Moreover, in coupling to signal paths to be switched, conventional microwave relays require relatively long transmission line lengths and relatively many connectors.

Solid state switching, using solid state transistors in place of electromechanical relays, cannot match the performance of the electromechanical relays for broadband or microwave signals in terms of insertion loss, impedance matching and cross-talk.

SUMMARY OF THE INVENTION

Principles of the invention provide, for example, electromechanical relays and semiconductor structures and microelectromechanical systems including at least part of an electromechanical relay.

In accordance with a first aspect of the invention, an electromechanical relay comprises an electrically conductive terminal within a printed circuit board, one or more electrically conductive contacts, and one or more magnetic actuators. The one or more magnetic actuators are respectively associated with the one or more electrically conductive contacts and each magnetic actuator comprises (i) a magnetic core within at least one via extending through one or more layers of the printed circuit board, and (ii) an electrical coil around at least a portion of the magnetic core and within one or more layers of the printed circuit board. Activation of the one or more actuators causes electrical contact between the terminal and an associated one of the one or more electrically conductive contacts.

In accordance with a second aspect of the invention, a method of forming an electromechanical relay is presented. The electromechanical relay formed is in accordance with the first aspect of the invention presented above. The method comprises etching a layer of magnetic material to form a substrate-metal structure for one or more electrically conductive contacts, electroplating the substrate-metal structure to form an electroplated substrate-metal structure, attaching the electroplated substrate-metal structure to the printed circuit board, and removing a portion of the electroplated substrate-metal structure to electrically decouple the one or more electrically conductive contacts of the relay.

In accordance with a third aspect of the invention, a semiconductor structure comprises a semiconductor substrate, at least one dielectric layer, and at least one metal layer deposited upon the semiconductor substrate or the at least one dielectric layer. The semiconductor structure further comprises an electromechanical relay. The electromechanical relay comprises an electrically conductive terminal within the semiconductor structure, one or more electrically conductive contacts, and one or more magnetic actuators. The one or more magnetic actuators are respectively associated with the one or more electrically conductive contacts. Each magnetic actuator comprises (i) a magnetic core within at least one via extending through one or more layers of the semiconductor structure, and (ii) an electrical coil around at least a portion of the magnetic core and within the at least one metal layer. Activation of the one or more actuators causes electrical contact between the terminal and an associated one of the one or more electrically conductive contacts.

In accordance with a fourth aspect of the invention, a microelectromechanical systems comprises a semiconductor substrate, at least one dielectric layer, and at least one metal layer deposited upon the semiconductor substrate or the at least one dielectric layer. The microelectromechanical systems further comprises an electromechanical relay. The electromechanical relay comprises an electrically conductive terminal within the microelectromechanical systems, one or more electrically conductive contacts within the at least one deposited metal layer, and one or more magnetic actuators. The one or more magnetic actuators are respectively associated with one of the one or more electrically conductive contacts. Each magnetic actuator comprises (i) a magnetic core within at least one via extending through one or more layers of the semiconductor structure, and (ii) an electrical coil around at least a portion of the magnetic core and within the at least one metal layer. Activation of the one or more actuators causes electrical contact between the terminal and an associated one of the one or more electrically conductive contacts.

Advantageously, principles of the invention provide, for example, high-performance switching of microwave signals using integrated electromechanical switching devices that provide impedance matching, low insertion loss and low cross-talk.

These and other features, objects and advantages of the present invention will become apparent from the following detailed description of illustrative embodiments thereof, which is to be read in connection with the accompanying drawings.

DETAILED DESCRIPTION OF THE INVENTION

Principles of the present invention will be described herein in the context of illustrative embodiments of single and multiple pole relays designed to carry microwave frequency electronic signals. Radio frequency signals between about 0.3 to about 300 gigahertz (GHz) are considered microwave frequency signals. It is to be appreciated, however, that the techniques of the present invention are not limited to the specific devices and method shown and described herein. Rather, principles of the invention are directed broadly to relays formed, at least in part, in a substrate such as a printed circuit board, microelectromechanical system (MEMS), integrated circuit or other semiconductor structure. For this reason, numerous modifications can be made to the embodiments shown that are within the scope of the present invention. No limitations with respect to the specific embodiments described herein are intended or should be inferred.

Principles of the invention integrate radio frequency signal paths and magnetic components of a multiple pole relay into a substrate, such as a printed circuit board, MEMS, integrated circuit or other semiconductor structure. Because of integrated aspects, the resulting structure is compact and relatively inexpensive to manufacture while preserving performance advantages of electromechanical relays over solid state switching devices. Furthermore, integration of relays into integrated circuits provides short, direct (e.g., without connectors) high performance (e.g., low loss and low distortion) interfacing of switching devices (i.e., relays) with other electronic devices such as processor devices.

Interfacing of integrated relays with integrated microstrip, stripline and/or coaxial transmission lines provides signal switching in a signal fabric within the printed circuit board, MEMS, integrated circuit or other semiconductor structure without the need for expensive and bulky intermediary connectors. In addition integration of the relay and transmission lines in a common substrate (e.g., printed circuit board, MEMS, integrated circuit or other semiconductor structure) may provide, for example, a high performance, low loss, switched signal path to one or more external transmission lines through connectors interfacing the integrated and external transmission lines.

Figure 1A:
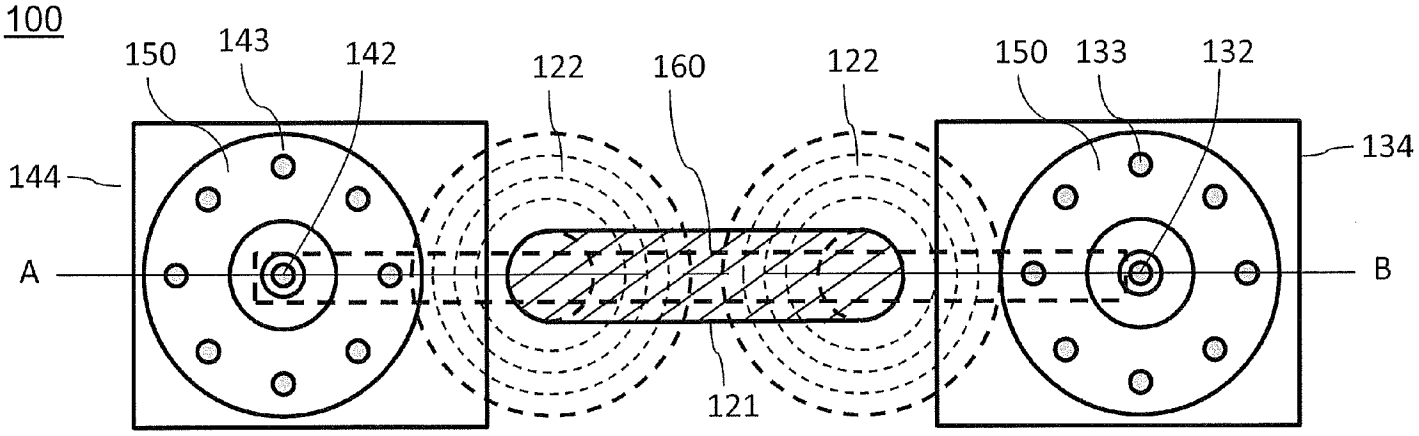
FIGS. 1A and 1B are top-down and cross-sectional views, respectively, illustrating a single pole electromechanical relay according to an exemplary embodiment of the invention.
Figure 1B:
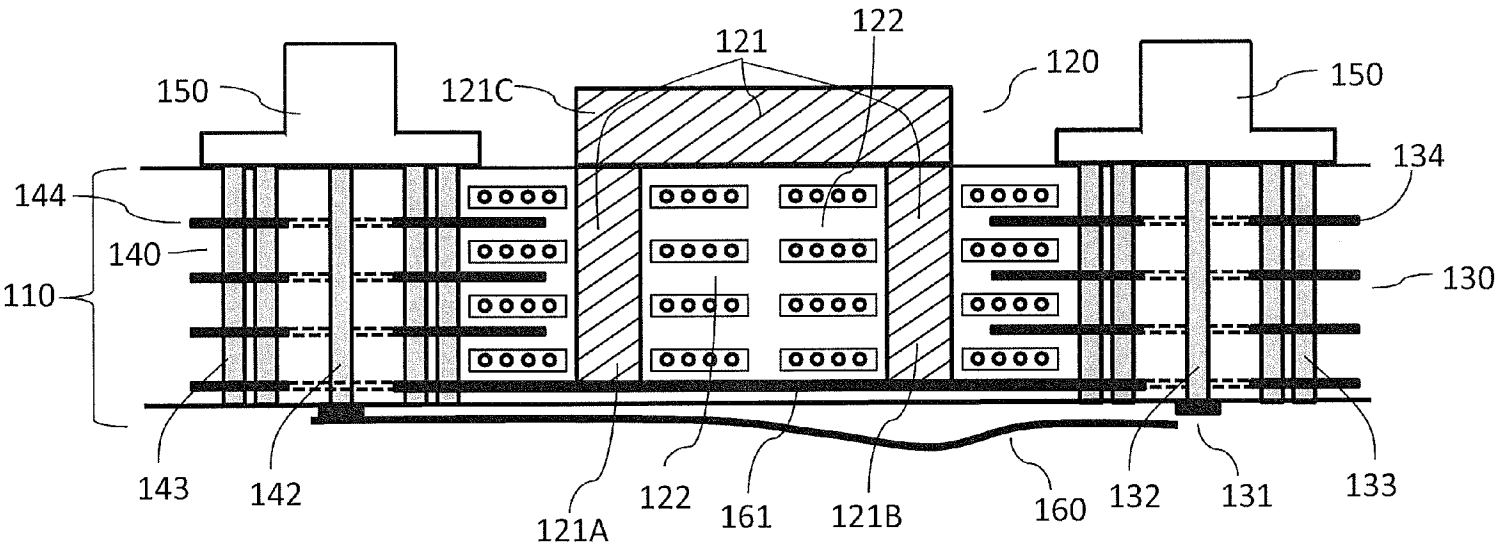

FIGS. 1A and 1B illustrate an electromechanical relay 100 according to an exemplary embodiment of the invention. FIG. 1A is a top-down view. FIG. 1B is a cross-sectional view, along axis A-B shown in the top-down view.

Relay 100 is formed or contained, at least in part, within a substrate such as a printed circuit board, MEMS, integrated circuit or other semiconductor structure. Exemplary embodiments of the invention will be presented herein where relays, or parts of relays (e.g., electromagnetic parts and/or transmission lines), and/or additional transmission lines are integrated within printed circuit boards. It is understood that the invention is not so limited and that relays, or portion of relays, and transmission lines may be integrated within other substrates, for example, MEMSs, integrated circuits or other semiconductor structures. The integration of relays, or parts of relays, and transmission lines into the other substrates is analogous to the integration into printed circuit boards.

The relay 100 comprises a contacting arm 160, a magnetic actuator 120, a terminal 130, a transmission line 140 and two connectors 150 (e.g., SMP connectors). The relay 100 further comprises at least a portion of a printed circuit board 110 because elements of the relay 100 (e.g., part or all of actuator 120, transmission line 140 and/or terminal 130) comprise, or are formed within, portions of the printed circuit board 110 and because the printed circuit board 110 is a support structure or substrate of the relay 100. The printed circuit board 110 is typically a multilayer printed circuit board comprising laminated conductive and dielectric (i.e., insulating or non-conductive) layers. The printed circuit board 110 may comprise, for example, conductive layers between dielectric layers. Each level of the printed circuit board 110 may comprise a conductive layer or a dielectric layer. The conductive layer is typically a metal (e.g., copper) and may have conductor traces (i.e., wires) and spaces (i.e. voids in the conductor) formed in the conductive layer. Some conductive layers may be coated, at least in part, with flux or solder.

The contacting arm 160 is electrically conductive and is coupled to (e.g., physically attached and/or electrically coupled to) transmission line 140. To enhance contact, the contacting aim 160 may be gold plated, at least at the part of the aim that contacts a terminal contact 131. When the relay 100 is activated (i.e., the actuator is activated and the conduction path of the relay closed or conductive), the contacting aim 160 is coupled to (e.g., physically and/or electrically contacting) the terminal 130 at terminal contact 131. In relay 100, the contacting arm comprises a magnetic material (e.g., iron, steel or another ferromagnetic material) and may be, for example, a leaf spring. When the actuator 120 is activated, the contacting arm 160 deflects towards the actuator 120 contacting the terminal 130 at terminal contact 131. When the actuator 120 is deactivated, the contacting arm 100 returns or springs back to a resting position, breaking connection with the terminal 130 and terminal contact 131. Typical deflection for the end of the contacting aim 160 that contacts the terminal 130 is about 0.01 inches (e.g., about 0.008 to 0.12 inches). In general, the contacting arm is an electrical conductor, and, specifically, in the relay 100, the contacting arm is a cantilever.

The contacting arm 160 may be part of a transmission line that further includes a return path (e.g., power plane or ground plane) 161. The return path 161 is in a metal layer transmission line conductor that is part of the printed circuit board 110. The transmission line comprising the contacting arm 160 and the return path 161 may be considered to be a microstrip transmission line.

In relay 100, the actuator 120 is associated with the contacting arm 160 and the terminal 130 because the actuator 120 controls contact between the contacting arm 160 and the terminal 130.

The magnetic actuator 120 comprises a core 121 consisting of three parts, a first core part 121A, a second core part 121B and a third core part 121C. The magnetic actuator 120 further comprises an electrical coil 122. The core 121 is considered a magnetic yoke of an electromagnet comprising the core 121 and the coil 122. The first core part 121A, the second core part 121B and the third core part 121C each comprise a magnetic conductor comprising magnetic material (e.g., iron or steel; magnetic material having high permeability). The first core part 121A and the second core part 121B are within a via or hole extending through one or more (e.g., all)-layers of the printed circuit board 110. The third core part 121C is magnetically and/or physically coupled to the first core part 121A and to the second core part 121B. The magnetic field may be enhanced or amplified by the core 121.

The core 121 comprises a magnetic material. When the magnetic actuator 120 is activated, a magnetic flux flows through the core and the contacting arm 160. The contacting arm 160 completes a magnetic flux path through the magnetic core 121.

The electrical coil 122 comprises windings around the first core part 121A and the second core part 121B. The windings are within one or more conductive layers of the printed circuit board 110. For example, a metal layer of the printed circuit board 110 may be etched to form a spiral conductor encircling or going around the first core part 121A and a similar (but opposite in winding direction) spiral conductor around the second core part 121B. Spirals having from two to ten turns of metal conductor around the core part 121A and 121B are suitable, although fewer or more turns are contemplated. By way of a non-limiting example only, a coil 122 comprises windings on from five to ten metal layers, with windings around both the first core part 121A and the second core part 121B, each winding having four turns, the winding around the first core part in a clockwise direction and the windings around the second core part 121B in a counter clockwise direction. All windings may be electrically coupled in series, in parallel or in a combination series/parallel arrangement.

As an example, consider the force and consequently the current needed to bring the contacting aim 160 in contact with the terminal contact 131. First consider the force needed to adequately deflect the contacting arm 160. For a simple cantilever contacting arm (i.e., a beam with fixed support at one end and free at the other) loaded by a force located at the end of the beam (this is conservative since the force is located at an intermediate location), the deflection is given by:

$$\text{Force}=(\text{Deflection}*3*E*I)/\text{Length}^3; \qquad \text{EQ. 1:}$$

where E is the elastic modulus of the aim and I is the moment of inertia of the cross-section of the arm. For an arm having a length of 6 millimeters (mm) and a deflection of 0.25 mm, which is typical of the anticipated geometries of embodiments of the invention, the force needed for deflection is about 0.03 Newtons (N). For this calculation, E equals 200,000 megapascal (MPa) and 1 equals 4e-17 kilogram meter$^2$ (kg m$^2$).

Continuing with the example, consider the current through the coil 122 that is necessary to produce the deflection force of 0.03 N. For the force generated by the magnetic actuator 120, an approximation is made that there is a uniform magnetic field in the air gap. The approximation is reasonable because the gap distance of 0.25 mm, corresponding to the deflection of 0.25 mm, is much less than the diameter of the core parts 121A and 121B, which in this example is 1.3 mm. It is also assumed that the reluctance of the path filled by the magnetic material will not contribute significantly to the total reluctance. This assumption requires the relative permeability of the core 121 to be above several hundred, a value that can be readily attained. The force exerted on the contacting arm 160 (a leaf spring cantilever) is given by:

$$\text{Force}=[(n*I)^2*\text{mu_0}*\text{Area}]/(2*\text{gap}^2); \qquad \text{EQ. 2:}$$

where n=number of turns of the coil 122, I is the current through coil 122, mu_0 is the permeability of free space ($4\pi\times10^{-7}$ Newton per Ampere$^2$) and Area is the cross-sectional area of the core 121B. In this example, the coil may have from 5 to 10 layers of turns, each layer of turns in a separate conductive layer of the printed circuit board 110, with 4 turns per layer of turns around each of the first core part 121A and the second core part 121B for a total of 8 turns per layer. From EQ. 2, the current needed to generate the 0.03 N of force is 1.2 Amperes (A) for 5 layers of windings and 0.6 A for 10 layers of windings. These currents are readily achievable although the low resistance of the windings may favor a current limited mode of operation. Note that a lower average power may be achieved by using the addition of a permanent magnet in the magnetic flux path to form a latching assembly. This provides a bistable solution with the coils providing a flux boost or buck to close or release, respectively, contact of the contacting arm 160 to the terminal contact 131.

Terminal 130 comprises a terminal contact 131 for contacting the contacting aim 160 when the actuator 120 is activated. The terminal 130 electrically couples the contacting arm to a first connector 150 when the actuator 120 is activated. The terminal 130 further comprises a transmission line comprising an inner electrical conductor 132 and an outer electrical conductor comprising eight electrically conductive, metal filled vias 133 and, optionally, metal ground planes 134. The transmission line may be considered a coaxial transmission line. The terminal contact 131 is coupled (e.g., electrically and/or physically connected) to the inner conductor 132. The metal filled vias 133 extend through the printed circuit board 110. The inner conductor 132 is also an electrically conductive metal filled via extending through the printed circuit board 110. Exemplary dimensions are about 0.010 to 0.014 inches for the diameter of the inner conductor 132 and spacing between the inner conductor 132 and the outer conductor metal filled vias is about 0.025 to 0.035 inches. By way of example only, the inner conductor 132 may be about 0.012 inches in diameter and all of the metal filled vias 133 of the outer electrical conductor may be contained in a minimal cylindrical shape having an inner radius of approximately 0.036 inches. Note that the metal filled vias 133 are approximately parallel to the inner conductor 132 and that more or less than eight metal filled vias 133 are contemplated.

The metal ground plane 134 preferably comprises a plurality of metal layers within the printed circuit board 110, the metal layers, and therefore the ground plane 134, are approximately perpendicular to the inner electrical conductor 132. Each or any of the plurality of metal layers may be between a winding of the coil 122 that is in one conductive layer of the printed circuit board 110 and another winding of the coil 122 that is in another conductive layer of the printed circuit board 110. Thus, a metal layer of a ground plane 134 may be a conductive layer of the printed circuit board 110 that is between two other conductive layers of the printed circuit board 110 which contain windings of the coil 122. This arrangement is efficient in terms of printed circuit board area. The metal ground plane 134 is considered a power plane electrically coupled to a power or voltage supply, in this case, a ground power or voltage supply. By way of examples only, the distance from the metal ground plane 134 to the inner conductor 132 may about 0.025 to 0.035 inches, and the metal ground planes 134 may terminate on a cylindrical shape having an inner radius of approximately 0.036 inches.

Alternate configurations of a metal ground plane are contemplated. For example, the metal ground plane may be on the same conductive layers of the printed circuit board that contain the windings of the coil. Although this arrangement may require more printed circuit board area, it may require fewer layers in the printed circuit board.

The metal ground plane 134 functions as at least part of a return current path for the transmission line comprising the inner electrical conductor 132. The metal ground plane 134 may optionally be electrically coupled to the winding of the coil 122 to provide partial connection to the winding of the coil 122 and to provide energizing current for the coil 122.

For signal integrity, low loss and to avoid stub resonances, interfacing of terminal 130 to a connector 150 requires a well controlled impedance of the transmission line of terminal 130. The spacing from the inner electrical conductor 132 to the metal filled vias 133 and to the metal ground planes 134 will affect performance as well as cross-talk to inactive channels of neighboring circuits and signal paths (e.g., other signal paths of relay 200). Geometries can be optimized using full wave simulation tools, and typically target a system impedance of 50 ohms. Cross-talk is an important figure of merit for microwave relays and there may be a tradeoff between power needed for magnetic actuation and RF isolation.

In relay 100, transmission line 140 electrically couples the contacting arm 160 to a second connector 150. The transmission line 140 is similar in structure and function to the transmission line of the terminal 130. Transmission line 140 comprises an inner electrical conductor 142 and an outer electrical conductor comprising eight electrically conductive, metal filled vias 143 and, optionally, metal ground planes 144. The contacting arm 160 is coupled (e.g., electrically and/or physically connected) to the inner conductor 142. The metal filled vias 143 extend through the printed circuit board 110. The inner conductor 142 is also an electrically conductive metal filled via extending through the printed circuit board 110. Exemplary dimensions are about 0.010 to 0.014 inches for the diameter of the inner conductor 142 and spacing between the inner conductor 142 and the outer conductor metal filled vias is about 0.025 to 0.035 inches. By way of example only, the inner conductor 142 may be about 0.012 inches in diameter and all of the metal filled vias 143 of the outer electrical conductor may be contained in a minimal cylindrical shape having an inner radius of approximately 0.036 inches. Note that the metal filled vias 143 are approximately parallel to the inner conductor 142 and that more or less than eight metal filled vias 142 are contemplated.

The metal ground plane 144 preferably comprises a plurality of metal layers within the printed circuit board 110, the metal layers, and therefore the ground plane 144, are approximately perpendicular to the inner electrical conductor 142. Each or any of the plurality of metal layers may be between a winding of the coil 122 that is in one conductive layer of the printed circuit board 110 and another winding of the coil 122 that is in another conductive layer of the printed circuit board 110. Thus, a metal layer of a ground plane 144 may be a conductive layer of the printed circuit board 110 that is between two other conductive layers of the printed circuit board 110 which contain windings of the coil 122. This arrangement is efficient in terms of printed circuit board area. The metal ground plane 144 is considered a power plane electrically coupled to a power or voltage supply, in this case a ground power or voltage supply. By way of examples only, the distance from the metal ground plane 144 to the inner conductor 142 may about 0.025 to 0.035 inches, and the metal ground planes 144 may terminate on a cylindrical shape having an inner radius of approximately 0.036 inches.

Alternate configurations of a metal ground plane are contemplated. For example, the metal ground plane may be on the same conductive layers of the printed circuit board that contain the windings of the coil. Although this arrangement may require more printed circuit board area, it may require fewer layers in the printed circuit board.

The metal ground plane 144 functions as at least part of a return current path for the transmission line 140. The metal ground plane 144 may optionally be electrically coupled to the winding of the coil 122 to provide partial connection to the winding of the coil 122 and to provide energizing current for the coil 122.

Note that any or all of the metal ground plane 134, the metal ground plane 144 and the return path 161 may be electrically and/or physically coupled and may further be coupled to a voltage or power supply (e.g., a ground voltage or power supply).

Alternate embodiments of the invention may use alternate nonmagnetic methods to actuate the contacting arm. Any structure that can produce a small mechanical deflection (e.g., from about 0.008 to 0.12 inches) is suitable. Therefore pneumatic actuators, piezoelectric actuators, temperature activated actuators and even mechanical detents can all be used to actuate a switched connection or a contacting with a terminal. Such actuators may be, at least in part, within a substrate, such as a printed circuit board, MEMS, integrated circuit or other semiconductor structure.

Figure 2:
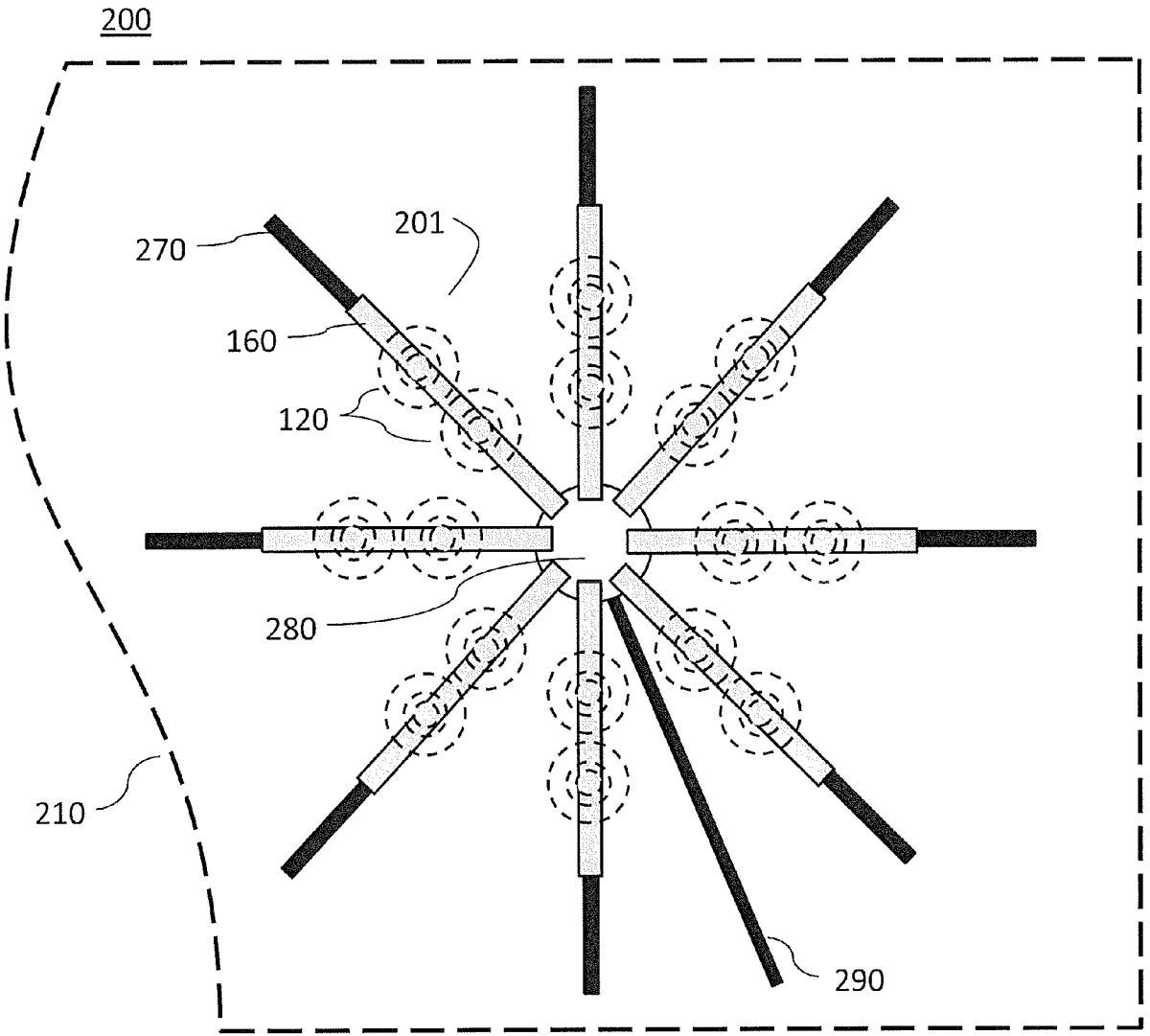
FIG. 2 illustrates a top-down view of a multiple pole electromechanical relay according to an exemplary embodiment of the invention.

FIG. 2 illustrates a top-down view of multiple pole relay 200 according to an exemplary embodiment of the invention. Relay 200 is, at least in part, within, or formed in, a substrate, such as a printed circuit board, MEMS, integrated circuit or other semiconductor structure. In the embodiment of FIG. 2, components of relay 200 are within, and are formed within, a printed circuit board.

The multiple pole relay 200 comprises at least a portion of a printed circuit board 210 because elements of the relay 200 (e.g., part or all of actuator 120, transmission lines 270 and 290 and/or central terminal 280) comprise portions of the printed circuit board 210 and because the printed circuit board 210 is a support structure or substrate for the relay 200. The printed circuit board 110 is typically a multilayer printed circuit board comprising laminated conductive and dielectric (i.e., insulating or non-conductive) layers. The printed circuit board 210 may comprise, for example, conductive layers between dielectric layers. The conductive layer is typically a metal (e.g., copper), may be coated, at least in part, with flux or solder, and may have conductor traces (i.e., wires) and spaces (i.e. voids) formed in the conductive layer.

Multiple pole relay 200 comprises eight relay structures 201 each coupled to a transmission line 270 and a central terminal 280. Each of the eight relay structures 201 are similar to relay 100 but without the terminal 130, the transmission line 140 and the two connectors 150. That is, the relay structures 201 comprise a contacting arm 160 and a magnetic actuator 120 that are structured and function in the same or similar way as the contacting arm 160 and the magnetic actuator 120 of relay 100 are structured and function. Besides having eight relay structures 201, multiple pole relay 200 differs from relay 100 in that: (i) there is one central terminal 280 that may be contacted by each of the eight contacting arms 160 of the eight relay structures 201 as compared to the one terminal 130 that may be contacted by the single contacting aim 160 of relay 100, (ii) for each relay structure 201, the transmission line 140 of relay 100 has been replaced by a microstrip or stripline transmission line 270, and (iii) the central terminal 280 is coupled to a microstrip or stripline transmission line 290 instead of to the transmission line 130 of relay 100.

The central terminal 280 is a conductive (e.g., metallic) disk on or in the surface of the printed circuit board 210. As illustrated in FIG. 2, the central terminal 280 is similar to terminal contact 131, but not coupled to the transmission line of contact 130 and large enough to contact the eight contacting anus without any of the eight contacting aims contacting another one of the eight contacting arms. As illustrated, the central terminal 280 is coupled to a microstrip or stripline transmission line 290.

Alternately, in place of the stripline or microstrip transmission line 290, the central terminal 280 could be coupled to a coaxial transmission line such as the transmission line of terminal 130. In this case, a multiple pole relay would comprise a terminal 130 that may be coupled to a connector 150.

The contacting arm 160 is electrically and possibly physically coupled to the transmission line 270. The transmission line 270 may be a microstrip or a stripline transmission line.

Thus, multiple pole relay 200 has eight contacting aims 160. The contacting of each contacting arm 160 with a central terminal 280 is controlled by an actuator 120 associated with each contacting arm 160. In this way, any of eight conduction paths from eight transmission lines 270 may be switched to contact the central terminal 280. Each of the eight conducting paths may conduct, for example, a direct current (DC), alternating current (AC), or radio frequency (e.g., microwave frequency between about 0.3 and 300 GHz) signal. Contacting of the contacting anus 160 with the central terminal 280 may occur only one contacting arm 160 at a time or multiple contacting aims 160 at a time. Note that the eight contacting arms 160 are positioned approximately as radii of a circle with the terminal at approximately the center of the circle.

Other configurations of multiple pole relays are contemplated. For example, a multiple pole relay, similar to multiple pole relay 200, but accessed through connectors 150 is contemplated. In this alternate configuration, the eight transmission lines 270 are replaced by transmission lines 140 each coupled to a connector 150, and, as mentioned above, the transmission line 290 is replaced by a a coaxial transmission line, such as the transmission line of terminal 130, coupled to a connector 150. This configuration is similar to eight relays 100 sharing a common terminal 130.

For relay 100, a signal (e.g., a microwave signal) may be input, form an external transmission line (e.g., an external coaxial transmission line) into the leftmost connector 150 of FIGS. 1A and 1B. The signal may then propagate through the transmission line 140, propagate, when the actuator 120 is activated, through the contacting arm 160 to the terminal contact 131, and propagate through the transmission line of terminal 130 to the rightmost connector 150. The signal may be output from the rightmost connector 150 to an external transmission line (e.g. an external coaxial transmission line). The signal propagating through the contacting arm 160 may be considered to propagate through a transmission line comprising contacting aim 160 and return path 161. Alternately, a signal may propagate through the same path but in the opposite direction.

Propagation of signals through relay 200 is similar to the propagation of signals through relay 100. For relay 200, signals may propagate from transmission lines 270 to the central terminal 280 according to activation of actuators 120 associated with the particular signal path. Alternately, signals may propagate through the same paths but in the opposite directions.

Figure 3A:
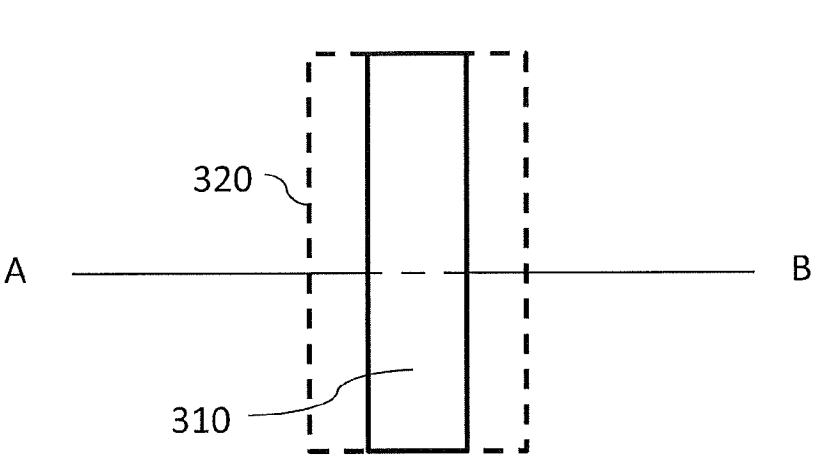
FIGS. 3A and 3B are top-down and cross-sectional views, respectively, illustrating a microstrip transmission line according to an embodiment of the invention.
Figure 3B:
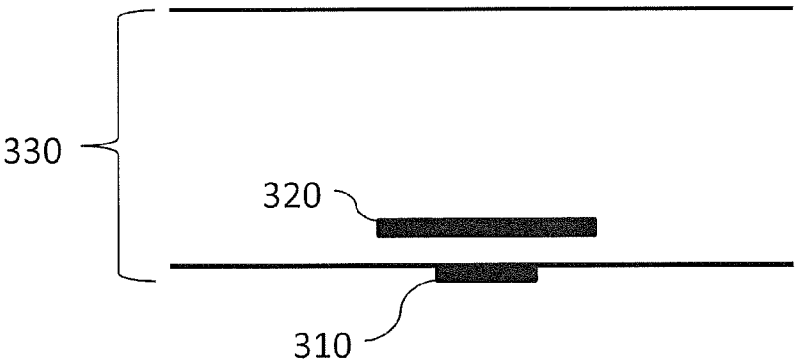

FIGS. 3A and 3B illustrate a microstrip transmission line 300 according to an embodiment of the invention. FIG. 3A is a bottom-up view. FIG. 3B is a cross-sectional view, along axis A-B shown in the bottom up view. Microstrip transmission line 300 may be representative of transmission line 270 and/or transmission line 290 when they are microstrip transmission lines. Microstrip transmission line 300 may also be representative of a microstrip transmission line comprising the contacting arm 160 and the return path 161.

A microstrip is a type of electrical transmission line which can be fabricated using printed circuit board, integrated circuit or MEMS technology and may be used to convey microwave frequency signals. A microstrip consists of a conducting strip (e.g., a primary conductor 310) separated from a return conductor (e.g., return conductor 320 or a ground plane) by a dielectric layer (e.g., a dielectric layer within the substrate 330). Microwave components such as antennas, couplers, filters, power dividers etc. can be formed from microstrip, the entire microstrip existing as the pattern of metallization within the printed circuit board. Microstrips may be less expensive to fabricate than traditional waveguide technology, as well as being lighter and more compact. Microstrip transmission lines may also be used in high-speed digital printed circuit boards, where signals need to be routed from one part of the printed circuit boards to another with minimal distortion, and avoiding high cross-talk and radiation.

The microstrip transmission line 300 comprises a primary conductor 310 and a return conductor 320. The primary conductor 310 may be coupled to, for example, the contacting aim 160 or to the central terminal 280. The return conductor 320 may be coupled to, for example, a power or voltage supply such as ground. The microstrip transmission line 300 further comprises at least a portion of a substrate 330 because elements of microstrip transmission line 300 (e.g., the primary conductor 310 and/or the return conductor 320) comprise portions of the substrate 310 and because the substrate 310 is a support structure for the microstrip transmission line 300. Although the microstrip transmission line 300 is shown comprising an exterior conductive layer and one interior conductive layer of the substrate 310, other configurations are possible, for example, comprising two interior conductive layers of a substrate. In this case, the primary conductor 310 may contact the contacting arm 160 using one or more conductive via connection, as know in the art for contacts between conductive layers of a substrate. The substrate may be, for example, a printed circuit board or a semiconductor substrate. For example, a MEMS or an integrated circuit may comprise the semiconductor substrate.

Figure 4A:
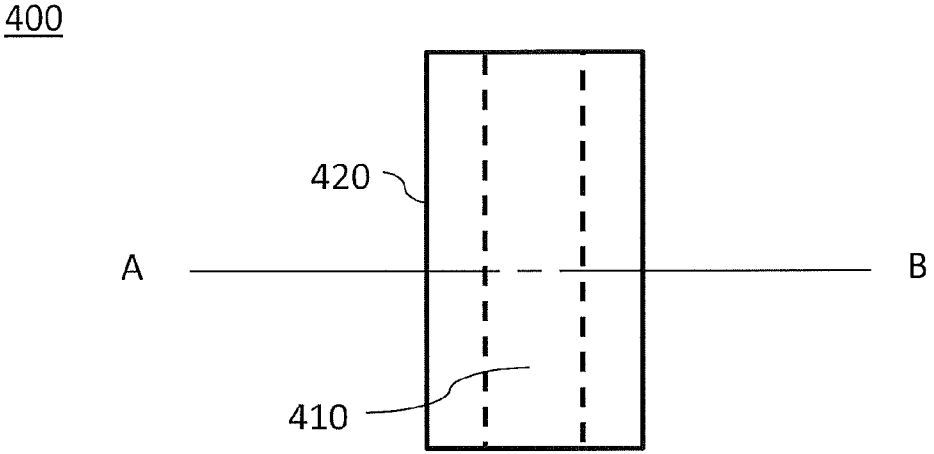
FIGS. 4A and 4B are top-down and cross-sectional views, respectively, illustrating a stripline transmission line according to an embodiment of the invention.
Figure 4B:
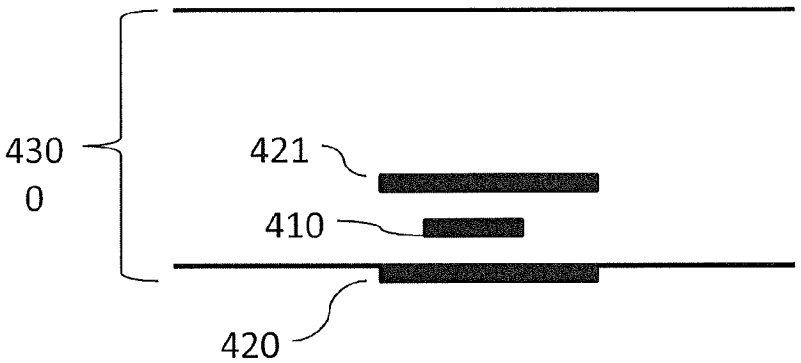

FIGS. 4A and 4B illustrate a stripline transmission line 400 according to an embodiment of the invention. FIG. 4A is a bottom-up view. FIG. 4B is a cross-sectional view, along axis A-B shown in the bottom up view. Stripline transmission line 400 may be representative of transmission line 270 and/or transmission line 290 when they are stripline transmission lines.

A stripline is a type of electrical transmission line which can be fabricated using printed circuit board technology, integrated circuit or MEMS technology and may be used to convey microwave-frequency signals. A stripline transmission line comprises a primary conductor (e.g., primary conductor 410) sandwiched between two outer conductors (e.g., return and/or ground conductors or planes, outer conductors 420 and 421). Dielectric layers are between the primary conductor and each outer conductor. The width of the primary conductor, the thickness of the dielectric layers and the relative permittivity of the dielectric layers determine, at least in part, the characteristic impedance of the stripline transmission. The central conductor may or may not be equally spaced between the outer conductors. The dielectric material may or may not be different above and below the central conductor. To prevent the propagation of unwanted modes, the two outer conductors should be electrically connected. This is commonly achieved by a row of vias running parallel to the stripline on each side.

Microwave components such as antennas, couplers, filters, power dividers etc. can be formed from striplines, the entire device existing as the pattern of metallization within the printed circuit board. Striplines may be less expensive to fabricate than traditional waveguide technology, as well as being lighter and more compact. Stripline transmission lines may also be used in high-speed digital printed circuit boards, where signals need to be routed from one part of the printed circuit boards to another with minimal distortion, and avoiding high cross-talk and radiation.

The stripline transmission line 400 comprises a primary conductor 410 and two outer conductors 420 and 421. The outer conductors 420 and 421 may be considered return conductors. The primary conductor 410 may be coupled to, for example, the contacting arm 160 or to the central terminal 280. The outer conductors 420 and 421 may be coupled to, for example, a power or voltage supply such as ground. The stripline transmission line 400 further comprises at least a portion of a substrate 430 because elements of stripline transmission line 400 (e.g., the primary conductor 410 and/or the outer conductors 420 and 421) comprise portions of the substrate 430 and because the substrate 430 is a support structure for the stripline transmission line 400. Although the stripline transmission line 400 is shown comprising an exterior conductive layer and two interior conductive layer of the substrate 430, other configurations are possible, for example, comprising three interior conductive layers of the substrate 430. The primary conductor 410 may contact the contacting arm 160 or the central terminal 280 using one or more conductive via connections, as know in the art for contacts between conductive layers of a substrate. The substrate may be, for example, a printed circuit board or a semiconductor substrate. For example, a MEMS or an integrated circuit may comprise the semiconductor substrate.

Figure 5:
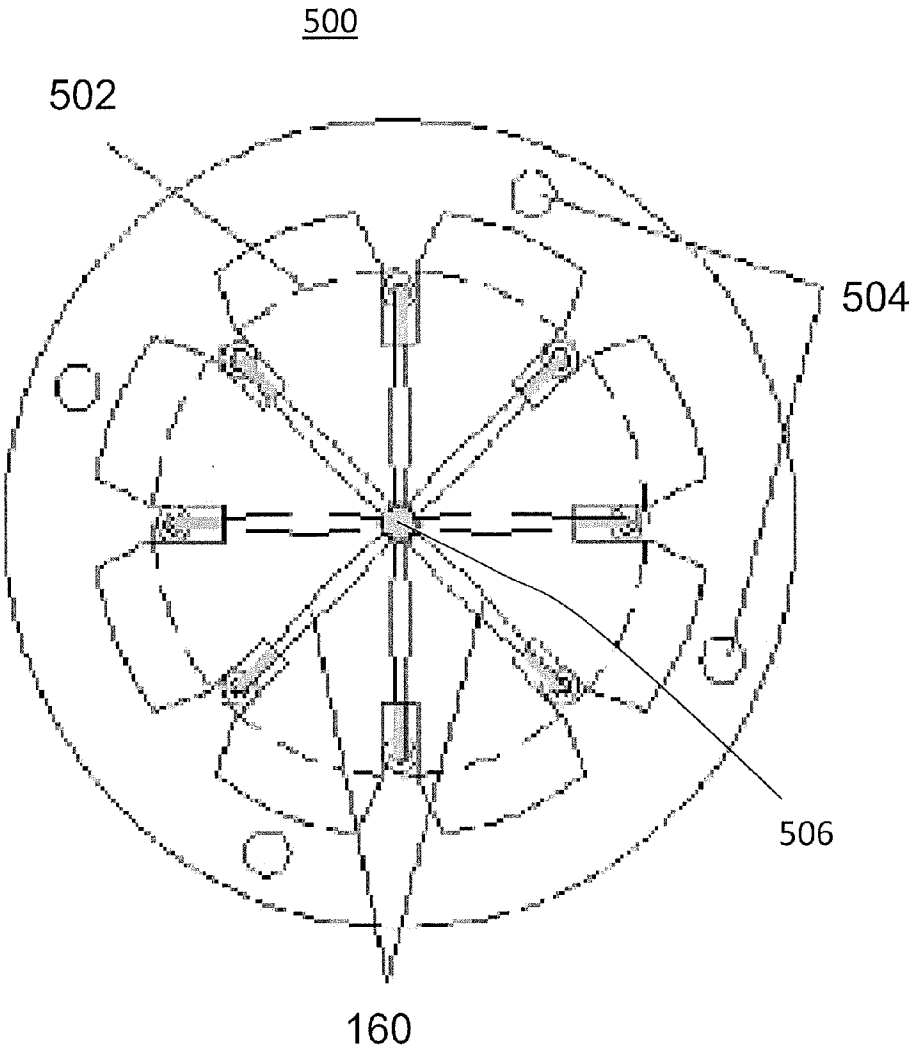
FIG. 5 shows a metallic disk structure for simultaneously forming multiple contacting arms of a multiple pole relay, such as the relay illustrated in FIG. 2, according to an embodiment of the invention.

For low cost, batch fabrication of relays is desirable. According to an exemplary embodiment of the invention and as illustrated in FIG. 5 by the metallic disk structure 500, for the multiple pole relay 200, all 8 leaf contacting arms 160 can be simultaneously formed and simultaneously attached to the printed circuit board 210 by the method shown in the flow diagram of FIG. 6.

Figure 6:
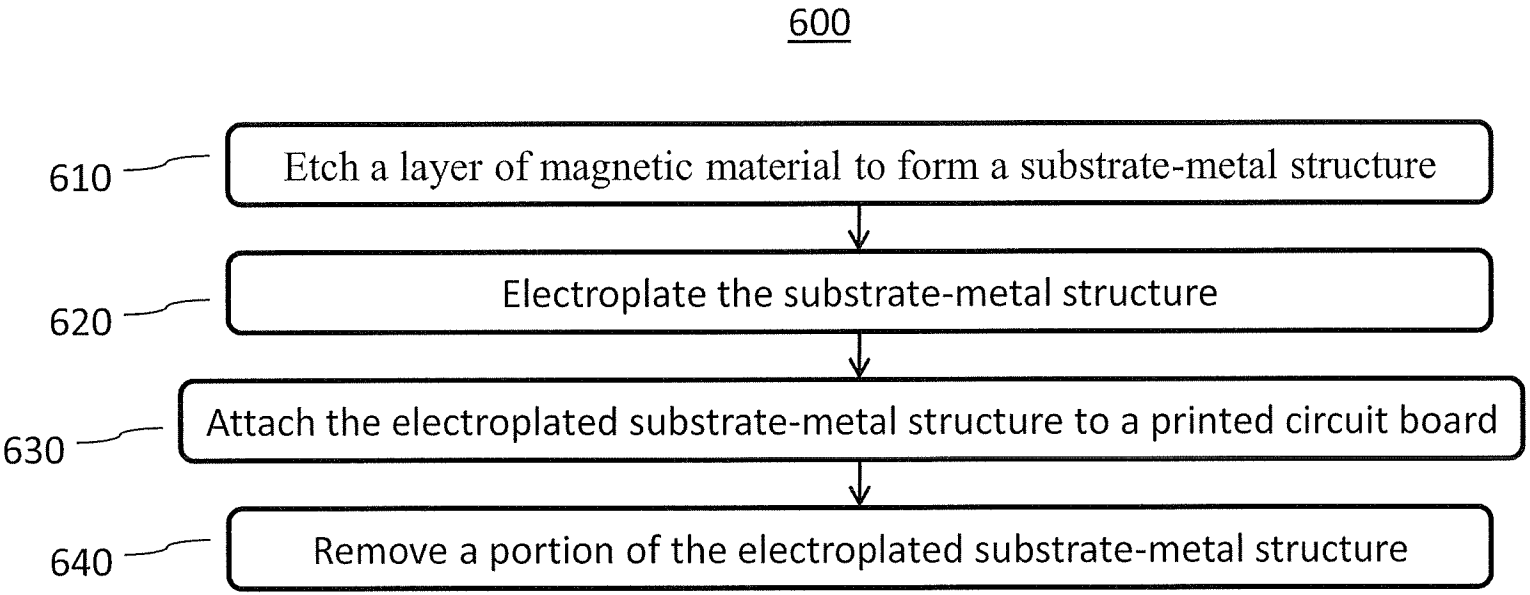
FIG. 6 is a flow diagram of a method for forming a multiple pole electromechanical relay, such as the relay shown in FIG. 2, according to an embodiment of the invention.

FIG. 6 is a flow diagram of a method for forming a multiple pole electromechanical relay (e.g., multiple pole relay 200) according to an embodiment of the invention. Step 610 comprises etching a relatively thin sheet of magnetic material (e.g., soft steel) to form a substrate-metal structure. The sheet of magnetic material is etched to form the shapes of the eight contacting arms 160 attached to an outer ring 502 and an inner ring 506. Step 620 comprises electroplating the substrate-metal structure to form an electroplated substrate-metal structure. Step 630 comprises attaching the electroplated substrate-metal structure to a printed circuit board 210. The electroplated substrate-metal structure may be mated to the printed circuit board 210 using locating pins protruding from the printed circuit board 210 that are placed into holes 504 in the electroplated substrate-metal structure. Using standard attachment techniques known in the art, the electroplated substrate-metal structure can be attached to the printed circuit board at points of attachment between the contacting arm 160 and contacts to the associated transmission line (e.g., microstrip or stripline transmission line 270 or a coaxial transmission line such as transmission line 140). These standard techniques comprise, for example, stenciling of solder paste to points of attachment and solder reflow. In this way, a rigid mechanical attachment is made between the contacting arms 160 and the printed circuit board 210. Step 640 comprises removing the outer ring 502 and the inner ring 506 of the electroplated substrate-metal structure so that the contacting arms 160 remain and are electronically decoupled from each other. The outer ring 502 and the inner ring 506 provided mechanical support for the contacting arms 160 prior to attachment to the printed circuit board 210.

The first core part 121A and the second core pare 121B can be formed from, for example, cylinders of appropriate diameter and press fit into the printed circuit board 210. The core part 121C can then be attached using the techniques similar to those used to attach the contacting arms 160.

Although embodiments of the invention have been presented as relays comprising printed circuit boards as substrates and as components of these embodiments, it is understood that other substrates, such as semiconductor structures (e.g., integrated circuits) may be used as or in place of the printed circuit board. A printed circuit board used in embodiments of the invention may comprise alternating conductive and dielectric layers. A semiconductor structure may also comprise alternating conductive and dielectric layers, such as alternating metal and silicon dioxide layers formed upon or above a silicon substrate. The conducting and dielectric layers of the semiconductor structure may be used in the same manner as the conductive and dielectric layers of the printed circuit board 110 or 210 are used and herein described. Thus, integrated circuits and other semiconductor structures may comprise at least a portion of relays (e.g., coil 122, core 121 and transmission lines 140, 270 and 290) according to embodiments of the invention.

Furthermore, the contacting arm 160 may be fabricated or formed within structures that are part of the integrated circuit. For example, at least one metal layer may be deposited upon the semiconductor substrate or one of the dielectric layers, and/or a dielectric layer may be grown upon or deposited on the semiconductor substrate. Also a dielectric layer may be deposited upon a metal layer. The contacting aim 160 may be formed (e.g., patterned and/or etched) within a metal layer deposited upon the semiconductor substrate or one of the dielectric layers.

Figure 7:
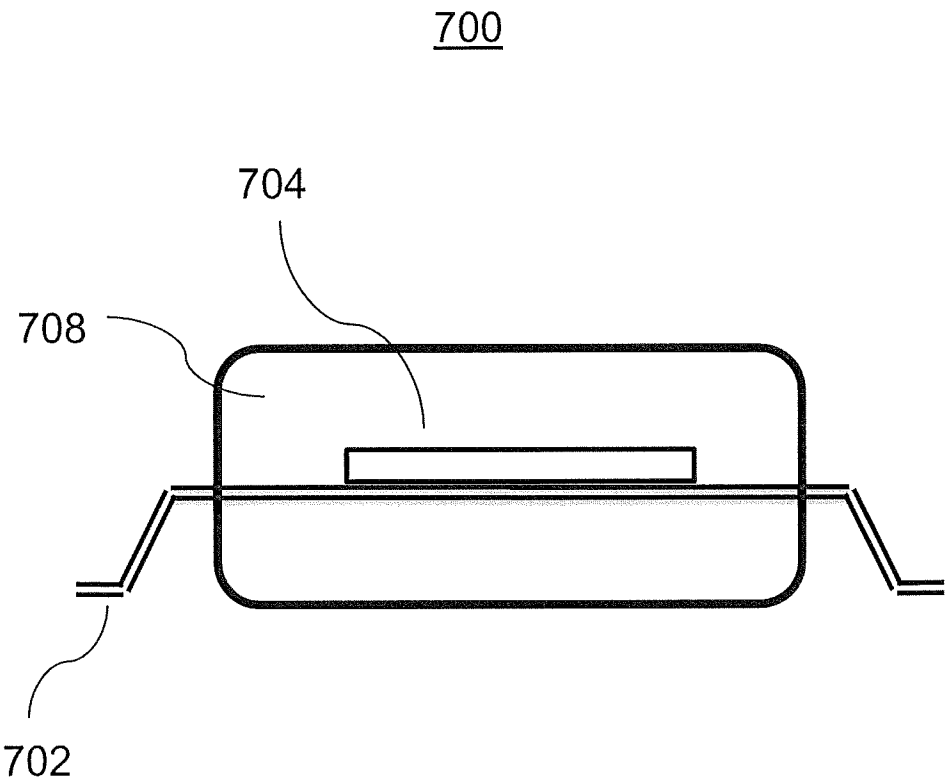
FIG. 7 is a cross-sectional view depicting an exemplary packaged integrated circuit according to an embodiment of the present invention.

FIG. 7 is a cross-sectional view depicting an exemplary packaged integrated circuit 700 according to an embodiment of the present invention. The packaged integrated circuit 700 comprises a leadframe 702, a die 704 attached to the leadframe, and a plastic encapsulation mold 708. Although FIG. 7 shows only one type of integrated circuit package, the invention is not so limited; the invention may comprise an integrated circuit die enclosed in any package type. The die 704 includes a device described herein, and may include other structures or circuits. For example, the die 704 includes at least one relay according to embodiments of the invention.

A MEMS may be formed using integrated circuit technology and may comprise the above semiconductor structure or integrated circuit with a mechanical device integrated into the integrated circuit. For example, the mechanical device may be foimed using etching, deposition, masking and photolithographic processes used to forming integrated circuits. The contacting arm of relays according to embodiments of the invention may be a mechanical device that is considered part of a MEMS and fowled using the above mentioned processes. Thus, relays according to certain embodiments of the invention may be considered MEMS.

Figure 8:
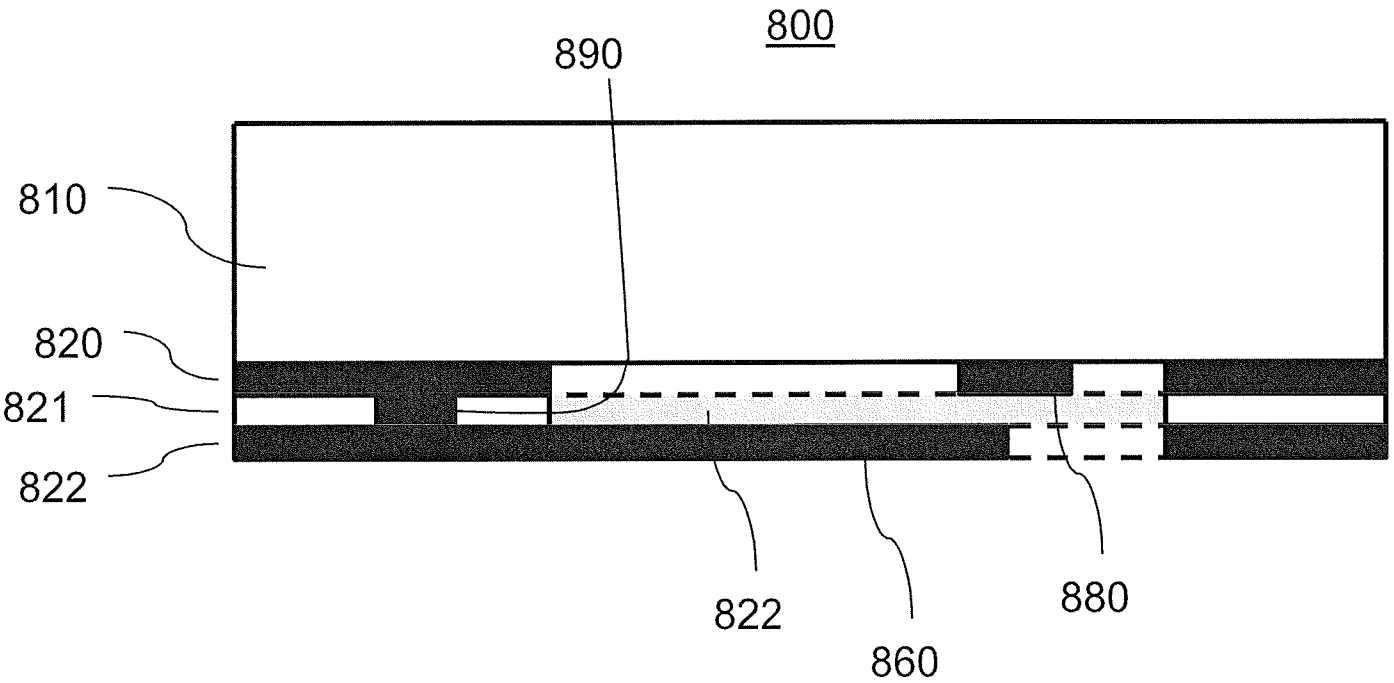
FIG. 8 is a cross-sectional view depicting an exemplary microelectromechanical system according to an embodiment of the present invention.

FIG. 8 is a cross-sectional view depicting an exemplary MEMS 800 according to an embodiment of the present invention. MEMS 800 comprises a semiconductor substrate 810, a first metal layer 820 deposited upon the semiconductor substrate 810, a first dielectric layer 821 deposited upon the first metal layer 820, and a second metal layer 822 deposited upon the first dielectric layer 821. By way of example only, the substrate may comprise silicon, the first metal layer may comprise aluminum or copper, the first dielectric layer may comprise silicon dioxide, and the second metal layer may comprise a magnetic electrically conductive metal if the relay is to be actuated by a magnetic actuator. If the relay is to be actuated by other types of actuators (e.g., pneumatic, piezoelectric or temperature activated), the second metal level could comprise, for example, aluminum or copper. The contacting arm is a cantilever 860 and the contacted terminal is terminal 880. Via 890 may connect the contacting arm 860 to circuitry or transmission lines in metal the first metal level 820. For simplify, other components of the MEMS, such as the actuator, transmission lines are not shown. A portion of the first dielectric layer 821 has been removed (e.g. etched or milled) and remains a void. The removed portion 822 is indicated in FIG. 8 by gray shading.

A relay, MEMS or integrated circuit in accordance with the present invention can be employed in applications, hardware and/or electronic systems. Suitable hardware and systems for implementing the invention may include, but are not limited to, personal computers, communication networks, electronic commerce systems, portable communications devices (e.g., cell phones), solid-state media storage devices, functional circuitry, etc. Systems and hardware incorporating such relays, MEMS or integrated circuits are considered part of this invention. Given the teachings of the invention provided herein, one of ordinary skill in the art will be able to contemplate other implementations and applications of the techniques of the invention.

It will be appreciated and should be understood that the exemplary embodiments of the invention described above can be implemented in a number of different fashions. Given the teachings of the invention provided herein, one of ordinary skill in the related art will be able to contemplate other implementations of the invention. Indeed, although illustrative embodiments of the present invention have been described herein with reference to the accompanying drawings, it is to be understood that the invention is not limited to those precise embodiments, and that various other changes and modifications may be made by one skilled in the art without departing from the scope or spirit of the invention.

What is claimed is:

1. A method of forming an electromechanical relay, the method comprising:

etching a layer of magnetic material on a substrate to foam a substrate-metal structure comprising a pattern of one or more electrically conductive contacts on a surface of the substrate;

electroplating the substrate-metal structure to form an electroplated substrate-metal structure;

attaching the electroplated substrate-metal structure to a surface of a multi-layered printed circuit board; and removing a portion of the electroplated substrate-metal structure to electrically decouple the one or more electrically conductive contacts;

wherein the multi-layered printed circuit board comprises:

a common contact terminal disposed within the multi-layered printed circuit board, wherein a first end of each of the one or more electrically conductive contacts is disposed in alignment to the common contact terminal; and one or more magnetic actuators respectively associated with the one or more electrically conductive contacts and each magnetic actuator comprising (i) a magnetic core comprising a first core part disposed within at least one via extending through one or more layers of the multi-layered printed circuit board, and (ii) an electrical coil disposed around at least a portion of the first core part of the magnetic core and within one or more layers of the multi-layered printed circuit board;

wherein in performing the attaching step, each of the one or more electrically conductive contacts is disposed in alignment to a corresponding one of the magnetic actuators to enable electrical contact between the common contact terminal and a given electrically conductive contact upon activation of a given magnetic actuator associated with the given electrically conductive contact.

2. The method of claim 1, further comprising:

etching a layer of magnetic material on a second substrate to form a second core part for each magnetic core of the one or more magnetic actuators; and attaching the second substrate to the multi-layered printed circuit board such that the second core part for each magnetic core is aligned to the first core part of a corresponding magnetic core.

3. The method of claim 1, wherein the pattern of one or more electrically conductive contacts formed on the surface of the substrate comprises a pattern of radially disposed electrically conductive contacts.

4. The method of claim 3, wherein removing the portion of the electroplated substrate-metal structure to electrically decouple the one or more electrically conductive contacts comprises removing a first metallic ring connected to the first ends of each of the radially disposed electrically conductive contacts, and removing a second metallic ring connected to second ends of each of the radially disposed electrically conductive contacts.

5. The method of claim 1, wherein attaching the electroplated substrate-metal structure to the surface of the multi-layered printed circuit board comprises attaching a second end of each of the one or more electrically conductive contacts to a corresponding contact terminal formed on the surface of the multi-layered printed circuit board.

6. The method of claim 1, wherein attaching the electroplated substrate-metal structure to the surface of the multi-layered printed circuit board comprises aligning pins formed on the surface of the multi-layered circuit board with holes formed in the electroplated substrate-metal structure.

* * * * *